United States Patent [19]

Bryson et al.

[11] Patent Number: 4,709,744

[45] Date of Patent: Dec. 1, 1987

[54] MODULAR MOULD SYSTEM AND METHOD FOR CONTINUOUS CASTING OF METAL INGOTS

[75] Inventors: Neil B. Bryson, Kingston; David T. T. Auchterlonie, Jonquiere; Guy LeBlanc, Longueuil; Vincent J. Newberry, Beaconsfield, all of Canada

[73] Assignee: Alcan International Limited, Kingston, Canada

[21] Appl. No.: 19,649

[22] Filed: Feb. 27, 1987

[30] Foreign Application Priority Data

May 27, 1986 [CA] Canada ..... 510072

[51] Int. Cl.[4] ..... B22D 11/04; B22D 11/07; B22D 11/124

[52] U.S. Cl. ..... 164/472; 164/137; 164/268; 164/341; 164/342; 164/444; 164/487

[58] Field of Search ..... 164/459, 487, 472, 444, 164/137, 341, 342, 418, 268

[56] References Cited

U.S. PATENT DOCUMENTS

| | | | |
|---|---|---|---|
| 3,749,152 | 7/1973 | Dore et al. | 164/444 X |
| 3,780,789 | 12/1973 | Unger | 164/444 X |
| 3,885,617 | 5/1975 | Foye | 164/444 |
| 3,887,157 | 6/1975 | Apatoczky | 164/444 |
| 4,597,432 | 7/1986 | Collins et al. | 164/444 |
| 4,598,763 | 7/1986 | Wagstaff et al. | 164/444 X |

FOREIGN PATENT DOCUMENTS

| | | | |
|---|---|---|---|
| 178950 | 3/1966 | U.S.S.R. | 164/444 |

*Primary Examiner*—M. Jordan
*Assistant Examiner*—J. Reed Batten, Jr.
*Attorney, Agent, or Firm*—Cooper, Dunham, Griffin & Moran

[57] ABSTRACT

The system includes: (a) a hollow cylindrical body adapted to be mounted in a casting table, (b) an annular water baffle removably mounted in the body, the baffle having a central opening through which a forming ingot passes and the baffle providing a flow path for cooling water to flow radially inwardly from the body and discharge inwardly and downwardly against a forming ingot passing through the central opening, (c) an annular mould removably mounted in the body immediately above the water baffle having a central forming cavity for forming a metal ingot, the forming cavity having a smaller diameter than the central opening of the water baffle, (d) a feed inlet for molten metal comprising an insulating ring removably mounted within the body immediately above the mould, the outer diameter of the insulating ring being less than the diameter of the body, (e) a pressure ring removably mounted in the body in the annular gap between the body and the outer diameter of the insulating ring, and (f) a cover plate adapted to compress the components of the mould system together. The annular members are selectively replaced with ones of variable inner diameter or length depending upon the diameter of ingot desired and the composition of the metal being cast.

12 Claims, 4 Drawing Figures

MODULAR MOULD SYSTEM AND METHOD FOR CONTINUOUS CASTING OF METAL INGOTS

BACKGROUND OF THE INVENTION

This invention relates to an improved mould system and method for the vertical continuous casting of molten metals, such as aluminum, to provide solidified circular cross section ingots for further processing into semi-fabricated metal products. More particularly, the invention relates to a mould apparatus for use in conjunction with a vertical, direct chill casting system for aluminum, magnesium and their alloys.

It is well known to those skilled in the art of direct chill casting that ingots of the highest surface and internal quality can be cast when the mould length is very short and precisely coordinated with the alloy, diameter and casting speed of each particular product it is desired to produce. This is shown, for example, in McCubbin U.S. Pat. No. 4,071,072. Only by using very short moulds of the order of 10–40 mm in length can the direct chill cooling effect be utilized to overcome the inevitable loss of ingot-mould contact which results from the formation of the air-gap.

There are a number of new mould designs based upon the above principles, which are equally capable of casting ingots of very high surface and internal quality. However, all of the new mould designs are characteristically complex in design, utilize expensive materials, must be built to close tolerances, and hence are relatively inflexible in terms of being able to cast high quality ingot only of the specific alloy and ingot diameter for which the mould is designed and constructed.

Unlike the casting of very large rectangular ingots, which are cast only in small numbers simultaneously, the major market for round cross-section ingots is in small to medium diameters, in the range of 125 to 250 mm. In order to obtain high productivity, large numbers of ingots, e.g. 24 to 96, must be cast simultaneously. Accordingly, mould inventory costs are very high for a plant producing a wide range of alloys and ingot diameters using the new generation moulds capable of casting very high quality ingot.

It is the object of the present invention to provide a simplified mould system which will be capable of casting very high quality ingots while greatly decreasing the cost of mould inventory.

SUMMARY OF THE INVENTION

This invention in its broadest aspect relates to a modular mould system for continuous casting of metal ingots. It includes a hollow cylindrical body which is adapted to be mounted in a casting table. An annular water baffle is removably mounted in a lower region of the cylindrical body and this baffle has a central opening through which a forming metal ingot passes with the baffle providing a flow path for cooling water to flow radially inwardly from the cylindrical body and discharge inwardly and downwardly against a forming ingot passing through the central opening. An annular mould is removably mounted in the cylindrical body immediately above the water baffle and this mould has a central forming cavity for forming a metal ingot, the forming cavity having a slightly smaller diameter than the central opening of the water baffle. A feed inlet for molten metal is provided immediately above the mould and this comprises an insulating ring or rings removably mounted within the cylindrical body and having an outer diameter which is less than the inner diameter of the cylindrical body. A pressure ring is removably mounted in the body in the annular gap between the inner face of the cylindrical body and the outer diameter of the insulating ring. Finally, a cover plate is provided for mounting above the feed inlet and pressure ring and this cover plate is fastened to the top of the body such as to compress components of the mould system together. This provides a close fit between the components.

An annular oil plate for feeding lubricating oil to the mould is mounted directly above the mould with a connection from the oil plate to an oil inlet in the cylindrical body.

With the modular mould system of this invention, rather than having to replace the entire structure each time a different alloy and/or ingot size is to be produced, only certain of the modular parts need be replaced. Thus, depending on the diameter or alloy of the ingot to be produced, it may be necessary to replace only two or three modular parts, rather than to replace the entire mould structure as is now conventional.

This provides a great saving in the mould inventory required for producing ingots of many different diameters and alloys.

BRIEF DESCRIPTION OF THE DRAWINGS

In the drawings which illustrate the invention.

DETAILED DESCRIPTION OF PREFERRED EMBODIMENTS

Figure 1:
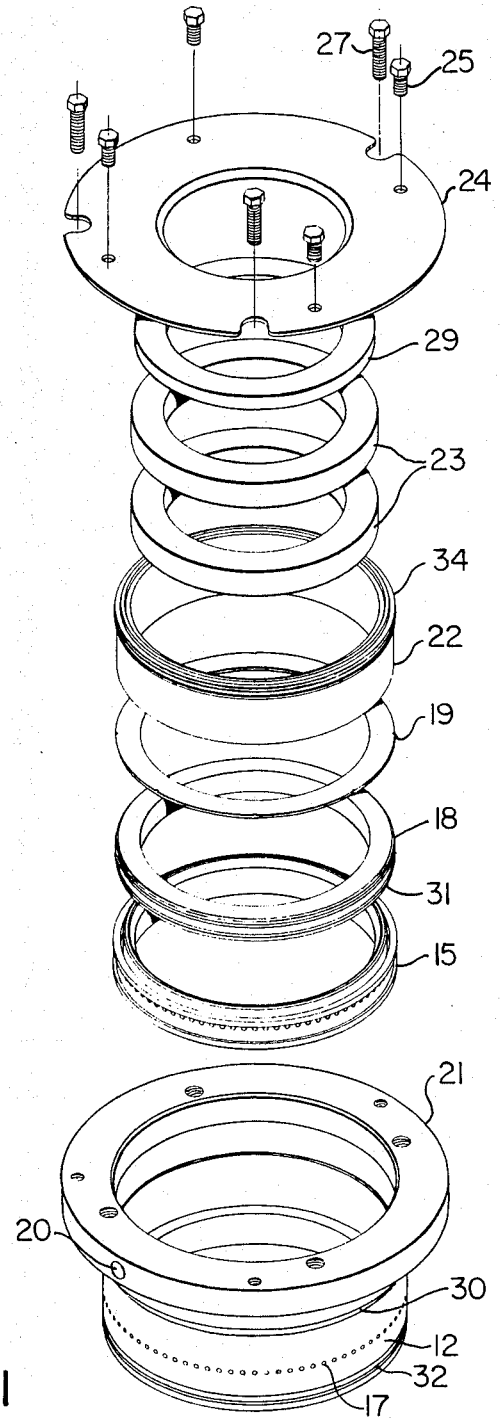
FIG. 1 is an exploded view of one embodiment of the invention.
Figure 2:
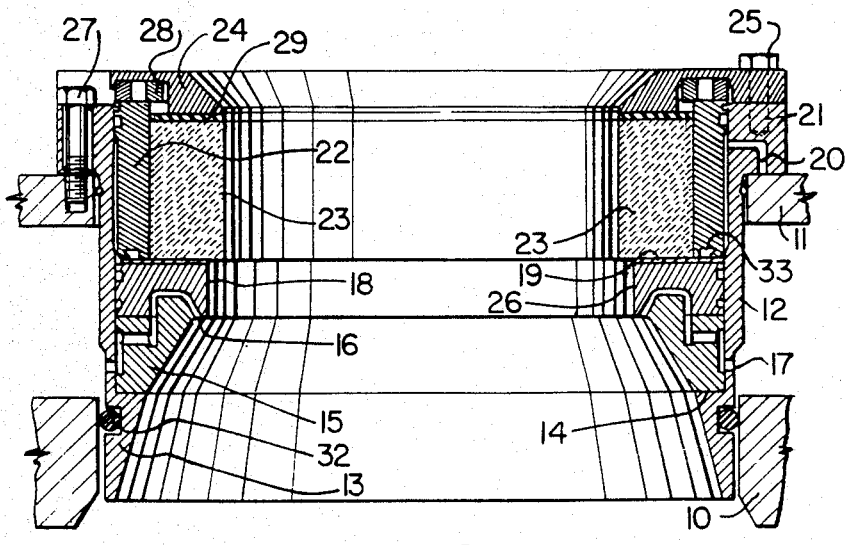
FIG. 2 is a cross-sectional view of one embodiment of the assembled mould system.

FIG. 2 shows a modular mould system designed to cast a 152 mm diameter ingot using a mould having a length of 20 mm. A casting table may contain as many as 96 individual moulds depending upon the diameter of the product to be cast. Supported by casting table bottom plate 10 and top plate 11 is a hollow cylindrical body 12 which is the main support structure for the internal components. This body 12 is snugly held within a hole in table bottom plate 10 by means of an O-ring 32 and held within a hole in top plate 11 by means of O-ring 30. It is fastened to top plate 11 by means of screws 27.

The bottom end of body 12 comprises an inward projection 13 forming on the top edge thereof an annular support shoulder 14. Supported on this shoulder 14 is an annular water baffle 15, preferably fabricated of steel. This water baffle provides water conduits 16 for delivering cooling water from water inlets 17 in body 12 to the inner edge of the baffle. There, the water is sprayed in an inward and downward direction onto a forming ingot emerging from the ingot mould.

Directly above the water inlet and water baffle is the mould proper 18. The inner cylindrical wall 26 of the mould 18 is of the appropriate dimensions to produce the desired circular cross-section ingot with very high surface quality and internal quality. The outer cylindrical wall of mould 18 is designed to fit snugly within body 12, with assistance of O-rings 31. A portion of the water conduit 16 is in the form of a gap between a portion of the bottom face of mould 18 and a portion of the top face of water baffle 15. This gap preferably loops upwardly within the mould to provide cooling of the mould by the water.

An annular oil plate 19 is positioned directly above the mould 18 and this plate has grooves in the bottom face thereof providing access for lubricating oil to the inner wall 26 of the mould 18. Oil is introduced through inlet 20 in the upper flange 21 of body 12.

An annular pressure ring 22, preferably of steel, is mounted snugly within body 12 directly above the oil plate 19. This ring 22 applies pressure to the mould 18 and water baffle 15, holding them firmly together. It includes an O-ring seal 34 above the oil inlet 20 to provide a tight seal between ring 22 and body 12. Extending downwardly below O-ring 34 is an annular gap 35 down through which oil travels to oil plate 19. The bottom face of pressure ring 22 includes a further O-ring 33 to provide a seal between the pressure ring 22 and oil plate 19, thereby assuring that the oil travels only along the top face of mould 18. Adjacent the inner cylindrical wall of pressure ring 22 are mounted insulating rings 23, preferably made of a ceramic insulating material. Finally there is mounted over the entire assembly a cover plate 24 which is bolted to flange 21 of body 12 by means of bolts 25. By tightening the bolts 25, the components of the mould assembly as described above are tightly held in their correct relationship for use. To provide some resilience within the assembly, springs means 28 are mounted in pockets between cover plate 24 and pressure ring 22. This assures that a uniform pressure is transmitted by pressure ring 22 to the mould 18 and water baffle 15. A further resilience is provided in the assembly by means of a compressible insulating gasket 29, e.g. Fibrefrax, mounted between cover plate 24 and insulating rings 23.

Figure 3:
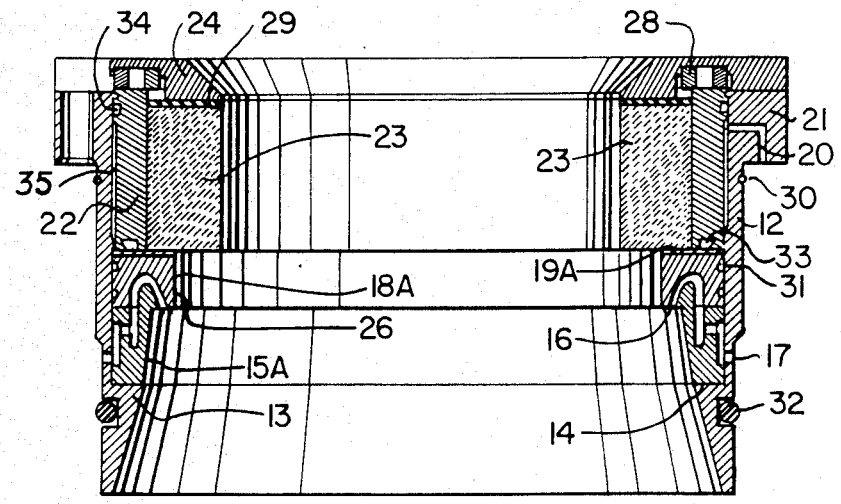
FIG. 3 is a cross-sectional view of a further embodiment of the invention.

If the assembly is to be changed to cast a larger diameter ingot, e.g. one having a diameter of 178 mm, then parts 15, 18 and 19 are replaced by parts **15*a*, 18*a* and 19*a*, as shown in FIG. 3**.

It can be seen that the water baffle **15*a* has an identical outer diameter but a greater inner diameter than water baffle 15. The mould 18*a* also has an identical outer diameter to mould 18, while having a greater inner diameter than mould 18 of 178 mm. The oil plate 19*a* also has an identical outer diameter and a greater inner diameter than oil plate 19. It is not necessary to change the pressure ring 22, insulating ring 23 and cover plate 24** when changing production between 152 mm diameter ingots and 178 mm diameter ingots.

Figure 4:
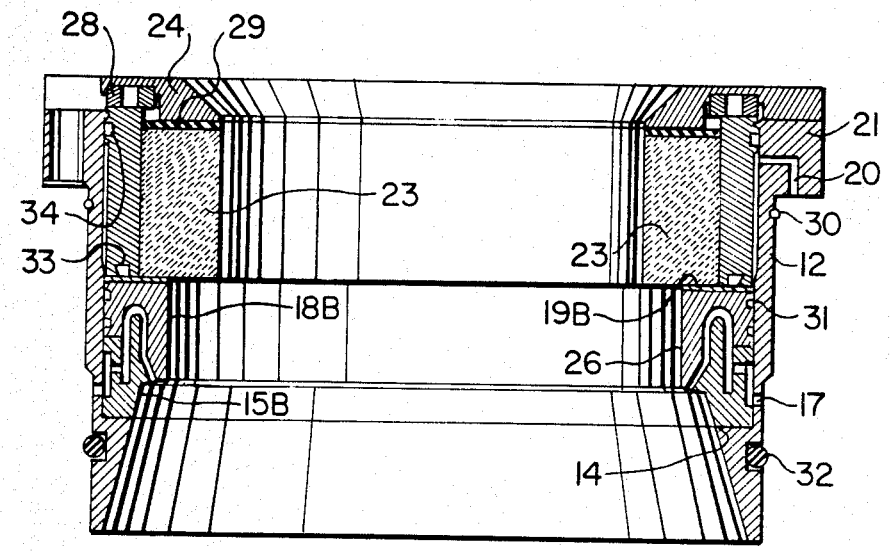
FIG. 4 is a cross-sectional view of a still further embodiment of the invention.

When the composition of the alloy is changed, it may be necessary to change the length of the mould even if the diameter is unchanged. Thus, FIG. 4 shows a mould assembly in which the mould **18*b* has the same diameter as mould 18*a* in FIG. 3, but has a greater length of 40 mm. This requires a different water baffle 15*b* such that the total length of the mould 18*b* and water baffle 15*b*** remains unchanged. No other change of components is necessary.

It is to be understood that the invention is not limited to the features and embodiments hereinabove specifically set forth, but may be carried out in other ways without departure from its spirit.

We claim:

1. A modular mould system for continuous casting of metal ingots comprising:

(a) a hollow cylindrical body adapted to be mounted in a casting table, (b) an annular water baffle removably mounted in said body, said baffle having a central opening through which a forming ingot passes and said baffle providing a flow path for cooling water to flow radially inwardly from the body and discharge inwardly and downwardly against a forming ingot passing through the central opening, (c) an annular mould removably mounted in the body immediately above the water baffle and having a central forming cavity for forming a metal ingot, said forming cavity having a smaller diameter than the central opening of the water baffle, (d) a feed inlet for molten metal comprising an insulating ring removably mounted within the body immediately above the mould, the outer diameter of said insulating ring being less than the diameter of the body, (e) a pressure ring removably mounted in the body in the annular gap between the body and the outer diameter of the insulating ring, and (f) a cover plate adapted to compress the components of the mould system together, wherein at least said annular members may be selectively replaceable with ones of variable inner diameter or length.

2. A modular mould system according to claim 1 wherein at least part of said cooling water flow path comprises a gap between the water baffle and mould.

3. A modular mould system according to claim 1 further comprising spring means provided between the pressure ring and the cover plate.

4. A modular mould system according to claim 1 further comprising a compressible insulating gasket provided between the insulating ring and the cover plate.

5. A modular mould system according to claim 1 which includes an annular oil plate positioned immediately above the mould for feeding oil to the mould, said oil plate being connected by a conduit to an oil inlet in the body and may be replaceable with ones of variable inner diameter.

6. A modular mould system according to claim 5 wherein at least part of said cooling water flow path comprises a gap between the water baffle and mould.

7. A modular mould system according to claim 5 further comprising spring means provided between the pressure ring and the cover plate.

8. A modular mould system according to claim 5 further comprising a compressible insulating gasket provided between the insulating ring and the cover plate.

9. A modular mould system according to claim 5 wherein the bottom end of the pressure ring presses against the oil plate and part of the oil conduit comprises an annular gap between the pressure ring and hollow cylindrical body.

10. A modular mould system according to claim 9 which includes a seal between the pressure ring and hollow cylindrical body above said annular gap.

11. A method for the production of aluminum ingots by direct chill continuous casting which comprises:

(1) forming a modular mould system comprising (a) a hollow cylindrical body adapted to be mounted in a casting table, (b) an annular water baffle removably mounted in said body, said baffle having a central opening through which a forming ingot passes and said baffle providing a flow path for cooling water to flow radially inwardly from the body and discharge inwardly and downwardly against a forming ingot passing through the central opening, (c) an annular mould removably mounted in the body immediately above the water baffle having a central forming cavity for forming a metal ingot, said forming cavity having a smaller diameter than the central opening of the water baffle, (d) an annular oil plate mounted on top of the mould, (e) a feed inlet for molten metal comprising an insulating ring removably mounted within the body immediately above the mould and resting on the oil plate, the outer diameter of said insulating ring being less than the diameter of the body, (f) a pressure ring removably mounted in the body in the annular gap between the body and the outer diameter of the insulating ring and resting on the oil plate, and (g) a cover plate adapted to compress the components of the mould system together;

(2) pouring molten aluminum into the top of the mould system;

(3) forming a continuous ingot in the mould; and (4) applying cooling water directly to the surface of the ingot emerging from the mould, characterized in that the diameter of the ingot to be produced may be changed by changing the annular water baffle, annular mould and oil plate with ones of a different inner diameter.

12. A method for the production of aluminum ingots by direct chill continuous casting which comprises:

(1) forming a modular mould system comprising (a) a hollow cylindrical body adapted to be mounted in a casting table, (b) an annular water baffle removably mounted in said body, said baffle having a central opening through which a forming ingot passes and said baffle providing a flow path for cooling water to flow radially inwardly from the body and discharge inwardly and downwardly against a forming ingot passing through the central opening, (c) an annular mould removably mounted in the body immediately above the water baffle having a central forming cavity for forming a metal ingot, said forming cavity having a smaller diameter than the central opening of the water baffle, (d) an annular oil plate mounted on top of the mould, (e) a feed inlet for molten metal comprising an insulating ring removably mounted within the body immediately above the mould and resting on the oil plate, the outer diameter of said insulating ring being less than the diameter of the body, (f) a pressure ring removably mounted in the body in the annular gap between the body and the outer diameter of the insulating ring and resting on the oil plate, and (g) a cover plate adapted to compress the components of the mould system together;

(2) pouring molten aluminum into the top of the mould system;

(3) forming a continuous ingot in the mould; and (4) applying cooling water directly to the surface of the ingot emerging from the mould;

characterized in that the mould system may be modified to cast a molten aluminum alloy of different composition by changing the annular mould with one of a different length and also changing the water baffle whereby the total length of the annular mould and water baffle remain unchanged.

* * * * *